US009125287B2

(12) United States Patent
Douglas

(10) Patent No.: US 9,125,287 B2
(45) Date of Patent: Sep. 1, 2015

(54) SEPARATED-ORBIT BISECTED ENERGY-RECOVERED LINEAR ACCELERATOR

(71) Applicant: JEFFERSON SCIENCE ASSOCIATES, LLC, Newport News, VA (US)

(72) Inventor: David R. Douglas, Yorktown, VA (US)

(73) Assignee: Jefferson Science Associates, LLC, Newport News, VA (US)

( * ) Notice: Subject to any disclaimer, the term of this patent is extended or adjusted under 35 U.S.C. 154(b) by 0 days.

(21) Appl. No.: 14/503,554

(22) Filed: Oct. 1, 2014

(65) Prior Publication Data

US 2015/0156859 A1 Jun. 4, 2015

Related U.S. Application Data

(60) Provisional application No. 61/910,321, filed on Nov. 30, 2013.

(51) Int. Cl.

| | |
|---|---|
| ***H05H 9/00*** | (2006.01) |
| ***H05H 7/00*** | (2006.01) |
| ***H05H 7/06*** | (2006.01) |

(52) U.S. Cl.

CPC . *H05H 9/00* (2013.01); *H05H 7/00* (2013.01); *H05H 7/06* (2013.01)

(58) Field of Classification Search

None

See application file for complete search history.

(56) References Cited

U.S. PATENT DOCUMENTS

| | | | | |
|---|---|---|---|---|
| 6,642,677 | B1 * | 11/2003 | Douglas | 315/505 |
| 7,859,199 | B1 * | 12/2010 | Benson et al. | 315/505 |
| 2010/0080356 | A1 * | 4/2010 | Ishida et al. | 378/121 |
| 2014/0187844 | A1 * | 7/2014 | Saito et al. | 600/1 |

* cited by examiner

*Primary Examiner* — Jany Richardson

(57) ABSTRACT

A separated-orbit bisected energy-recovered linear accelerator apparatus and method. The accelerator includes a first linac, a second linac, and a plurality of arcs of differing path lengths, including a plurality of up arcs, a plurality of downgoing arcs, and a full energy arc providing a path independent of the up arcs and downgoing arcs. The up arcs have a path length that is substantially a multiple of the RF wavelength and the full energy arc includes a path length that is substantially an odd half-integer multiple of the RF wavelength. Operation of the accelerator includes accelerating the beam utilizing the linacs and up arcs until the beam is at full energy, at full energy executing a full recirculation to the second linac using a path length that is substantially an odd half-integer of the RF wavelength, and then decelerating the beam using the linacs and downgoing arcs.

18 Claims, 2 Drawing Sheets

SEPARATED-ORBIT BISECTED ENERGY-RECOVERED LINEAR ACCELERATOR

This application claims the priority of Provisional U.S. Patent Application Ser. No. 61/910,321 filed Nov. 30, 2013.

The United States Government may have certain rights to this invention under Management and Operating Contract No. DE-AC05-06OR23177 from the Department of Energy.

FIELD OF THE INVENTION

The present invention relates to energy recovery linear accelerators (ERL) and more particularly an ERL that includes independent control of all the passes of a charged particle beam during recirculation.

BACKGROUND OF THE INVENTION

Numerous recent proposals such as JLAMP (JLab AMPlifier), a 4th generation light source covering the range 10 eV-100 eV in the fundamental mode with harmonics to 1 keV, and the LHeC (Large Hadron Electron Collider) Test ERL have invoked recirculation and energy recovery as a means of cost-performance optimization for linear accelerators. Solutions for such systems, to date, typically involve common recirculation transport of accelerated and recovered beams, sometimes over long distances. This imposes significant constraints on both performance and operability, as multiple beams must be managed using a common set of accelerator components.

What is needed is a method and apparatus for eliminating common beamline transport of accelerated and energy-recovered beams, enabling completely independent control of all passes of the beam at all energies during recirculation, thereby resulting in improved performance and operability.

OBJECT OF THE INVENTION

It is therefore an object of the present invention to provide an energy recovery linear accelerator that includes independent control of all the passes (at each of the various energies) of a charged particle beam during recirculation, thereby improving the control, performance, and operability of the ERL.

SUMMARY OF THE INVENTION

According to the present invention there is provided a separated-orbit bisected energy-recovered linear accelerator for providing independent control of all the passes of a charged particle beam during recirculation. The separated-orbit bisected energy-recovered linear accelerator includes a first linac, a second linac, and a plurality of arcs of (possibly) differing path lengths, including a plurality of up arcs (which transport beam that is undergoing acceleration), a plurality of downgoing arcs (which transport beam that is undergoing energy recovery), and a full energy arc providing a path completely independent of the up arcs and downgoing arcs. Each of the up arcs have a path length that is substantially a multiple of the RF wavelength and the full energy arc includes a path length that is substantially an odd half-integer multiple of the RF wavelength. Operation of the separated-orbit bisected energy-recovered linear accelerator includes accelerating the beam sequentially through the first linac, a first up arc, the second linac, a second up arc, the first linac, a third up arc, and the second linac, after which the beam reaches full energy. At full energy, the full energy arc executes a full recirculation back to the second linac, using a path length that is substantially an odd half-integer of the RF wavelength. When the beam is reinjected into the second linac, it is recovered to approximately the energy used in the third up arc, but at the opposite end of the first linac from the third up arc, and is then recirculated using a first downgoing arc of pathlength that is substantially a full integer multiple of the RF wavelength. Following this recirculation, the beam is reinjected into the first linac and decelerated again, to approximately the energy of the second up arc, but again on the geometrically opposite side of the machine. The process continues in identical fashion, with a second downgoing arc, and a third downgoing arc recirculating the second pass through, in order through the second linac and first linac, and finally delivering the low energy final beam to the end of the first linac where it can be extracted to a beam dump.

DETAILED DESCRIPTION

The current invention is a method and apparatus that provides a topology for bisected linear accelerators that entirely eliminates common beamline transport of accelerated and energy-recovered beams, thereby allowing completely independent control of all passes of all energy beams during recirculation.

Figure 1:
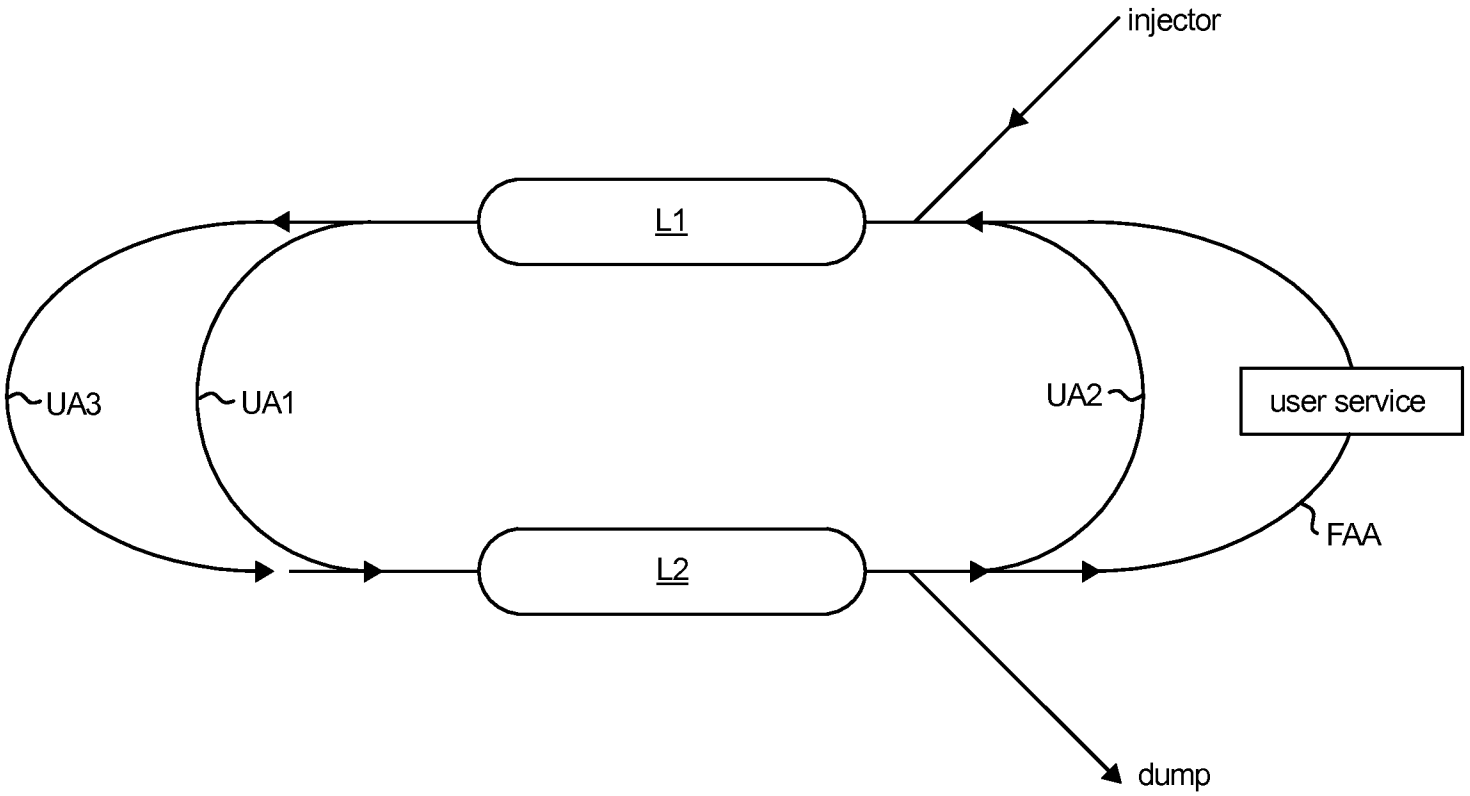
Fig. 1 (PRIOR ART)
FIG. 1 is a block diagram of the layout of a conventional (non-separated orbit) bisected-linac-based ERL.

With reference to FIG. 1 there is shown the conventional embodiment of a bisected ERL that illustrates the need for providing independent control of all the passes of an energy beam during recirculation. An injected low energy beam is brought into first linac L1, accelerated, recirculated through first up arc UA1, directed into second linac L2, accelerated, recirculated through second up arc UA2, reinjected into L1 for a second pass, recirculated using third up arc UA3, reinjected into L2 for a second pass, and brought to full energy. All arcs are required to be substantially a multiple of the RF wavelength so as to insure synchronism of the accelerated beam with the linac RF accelerating fields.

At full energy the beam is recirculated by full energy arc FAA, wherein it is used and thereafter returned to L1 to begin the energy recovery process. This process is initiated by the choice of the path length of FAA to be substantially an odd half-integer multiple of the RF wavelength (N+½, with N an odd integer), which insures the beam to be recovered is synchronous with the decelerating phase of the linac RF fields.

Energy recovery in such a system proceeds as follows: After FAA, the beam in injected into L1 and decelerated to substantially match the energy set point of UA3; it is recirculated using UA3, injected into L2 wherein it is decelerated to substantially match the energy set point of UA2. It is recirculated using UA2, injected into L1, wherein it is further decelerated to substantially the energy set point of UA1, wherein it is recirculated and injected to L2, wherein it is further decelerated to low energy, whereupon it is extracted from the accelerator at the end of L2 and directed to a beam dump.

Synchronism of the beam and linac RF fields during deceleration is insured by the same choice of recirculator UA1, UA2, and UA3 path lengths used to provide synchronism during acceleration, together with the selection of an odd half-integer multiple of the RF wavelength for the path length of FAA. All three lower energy arcs must be of sufficiently large energy acceptance to allow transport of both accelerated and recovered beam, must provide sufficient working aperture in parameter space to allow transport of beams with potentially different properties (e.g. Twiss parameters, bunch length, energy, momentum spread, etc.), and must be designed to be either error insensitive, provide completely local diagnosis and correction of errors, or have special means (including appropriate diagnostics) for global correction of multiple beams in a common structure. Variations of the path lengths from half-integer or full-integer multiples of the RF wavelength, and/or user processes extracting beam power at full energy (e.g. an FEL, or synchrotron radiative loss) lead to energy deviations between beams in the common transport, forcing use of larger energy acceptance transport arcs. All these features severely constrain design and operational flexibility and have potentially deleterious impact of performance.

Figure 2:
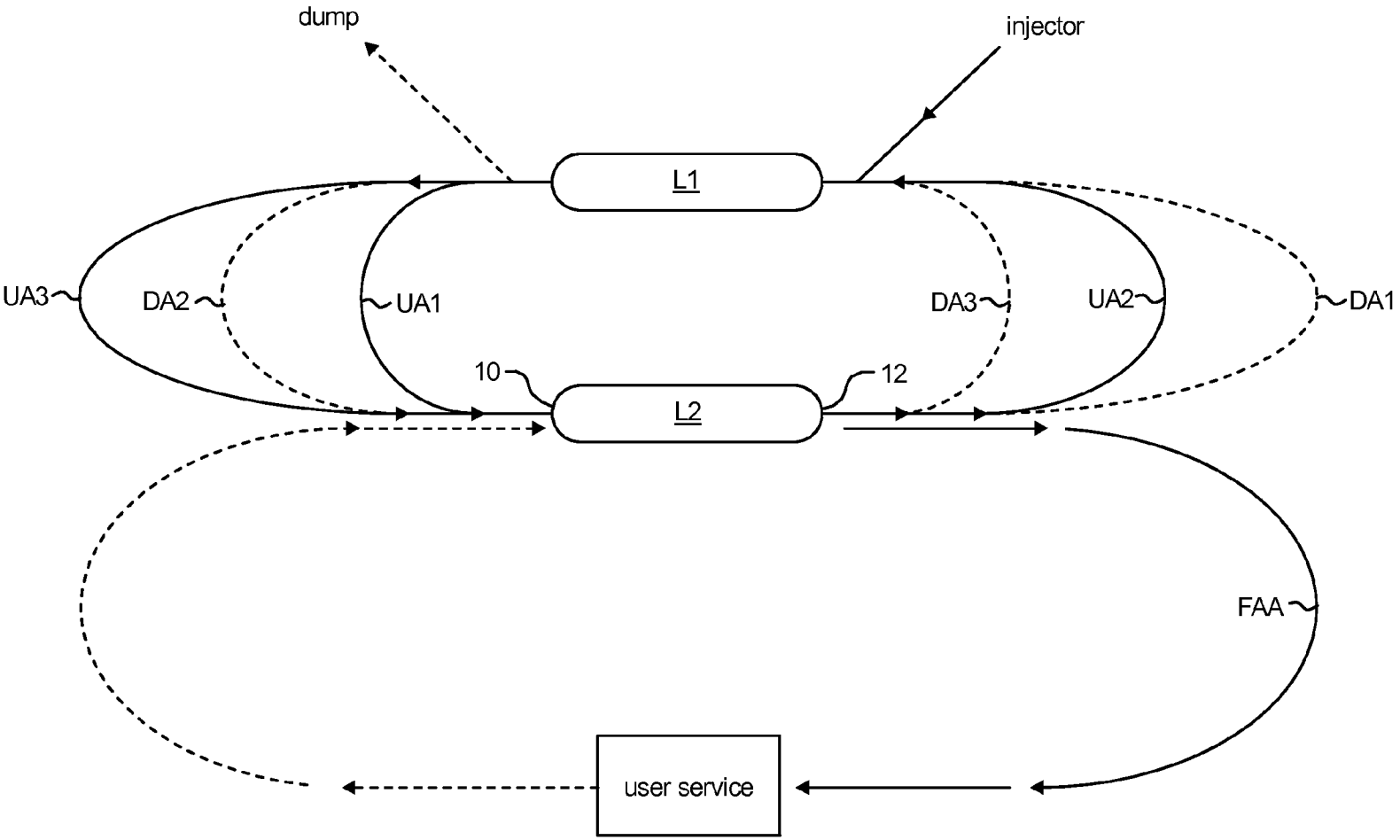
FIG. 2 is a block diagram of the layout of a separated orbit bisected energy recovered linac according to the present invention.

A preferred embodiment of an ERL having instead a separated orbit topology according to the present invention is shown in FIG. 2, and involves the same sequence of events and constraints during the acceleration cycle: the beam traverses L1, UAL L2, UA2, L1, UA3, L2, and reaches full energy. At full energy, however, FAA does not recirculate back to L1, it executes a full recirculation from the output end 12 of L2 back to the input end 10 of L2, using a path length that is substantially an odd half-integer of the RF wavelength. When the beam is injected into L2, it is recovered to approximately the energy used in UA3—but at the opposite end of L1 from UA3. It therefore can be recirculated using a first downgoing arc DA1 of pathlength that is substantially a full integer multiple of the RF wavelength. Following this recirculation, the beam is reinjected into L1, decelerated again—to approximately the energy of UA2, but again on the geometrically opposite side of the machine. The process continues in identical fashion, with a second downgoing arc DA2, and a third downgoing arc DA3 recirculating the second pass through, in order through L2 and L1, delivering the low energy final beam to the end, now, of L1 where it can be extracted to a beam dump.

The advantages of this topology are obvious to any of ordinary skill in the art. All beams are in unique and individual transport lines. They can therefore be phased (timed), focused, and have their individual transport matched in energy to the beam energy. The requisite energy and spatial acceptance of the transport can thereby be reduced. Error correction is entirely decoupled from beam to beam and pass to pass. Energy loss during full energy user service can be immediately accommodated by choice of path length of FAA. Path length constraints are eased, as pass-to-pass synchronism can be adjusted individually and independently for each pass of each beam. In addition, the various passes of beams in L1 are all at lower energy than the various passes of beams in L2. Advantageously the focusing structure of each linac can be appropriately modified to provide better control of all beams in each structure.

Design and operational flexibility, and resulting system performance are thus greatly enhanced at modest beam transport system cost. The embodiment of this method and device is not limited to the specific number of passes and arcs used in the aforegoing examples, but may be larger or smaller as dictated by the specific situation or application.

What is claimed is:

1. A method of controlling the recirculation of an energy recovery linear accelerator (ERL) accelerated by radio frequency (RF) energy having an RF wavelength comprising:

a. providing an injector for producing a charged particle beam, a first linac, and a second linac having an input end and an output end;

b. providing a plurality of up arcs between the first linac and second linac including a first up arc, a second up arc, and a third up arc;

c. providing a plurality of downgoing arcs between the first linac and second linac including a first downgoing arc, a second downgoing arc, and a third downgoing arc;

d. providing a full energy arc between the output end and the input end of the second linac;

e. operating the ERL wherein the energy beam is accelerated by each of the up arcs and afterwards returned to the second linac by the full energy arc;

f. decelerating the energy beam by recirculating it sequentially through each of the downgoing arcs, the first linac, and the second linac; and g. delivering the low energy final beam to the end of the first linac to be extracted to a beam dump.

2. The method of claim 1 wherein each of the up arcs have a path length that is substantially a multiple of the RF wavelength.

3. The method of claim 1 wherein each of the downgoing arcs have a path length that is substantially a multiple of the RF wavelength.

4. The method of claim 1 wherein the full energy arc includes a path length that is substantially an odd half-integer multiple of the RF wavelength.

5. The method of claim 1 wherein the up arcs have differing path lengths from one another and from that of the full energy arc and from those of the downgoing arcs.

6. The method of claim 1 wherein the downgoing arcs have differing path lengths from one another and from that of the full energy arc or those of the downgoing arcs.

7. The method of claim 1 wherein a different number of passes and different number of up arcs and downgoing arcs are used.

8. A separated-orbit bisected energy-recovered linear accelerator comprising:

a. an injector for producing a charged particle beam, a first linac, and a second linac having an input end and an output end;

b. a plurality of up arcs between the first linac and second linac including a first up arc, a second up arc, and a third up arc;

c. a plurality of downgoing arcs between the first linac and second linac including a first downgoing arc, a second downgoing arc, and a third downgoing arc;

d. a full energy arc between the output end and the input end of the second linac; and e. a beam dump at the end of the first linac.

9. The separated-orbit bisected energy-recovered linear accelerator of claim 8 wherein each of the up arcs have a path length that is substantially a multiple of the RF wavelength.

10. The separated-orbit bisected energy-recovered linear accelerator of claim 8 wherein each of the downgoing arcs have a path length that is substantially a multiple of the RF wavelength.

11. The separated-orbit bisected energy-recovered linear accelerator of claim 8 wherein the full energy arc includes a path length that is substantially an odd half-integer multiple of the RF wavelength.

12. The separated-orbit bisected energy-recovered linear accelerator of claim 8 wherein the up arcs have differing path lengths from one another and those of the full energy arc and the downgoing arcs.

13. The separated-orbit bisected energy-recovered linear accelerator of claim 8 wherein the downgoing arcs have differing path length from one another and those of the full energy arc and the up arcs.

14. The separated-orbit bisected energy-recovered linear accelerator of claim 8 wherein a different number of passes and different number of up arcs and downgoing arcs are used.

15. A separated-orbit bisected energy-recovered linear accelerator comprising:

a. an injector for producing an energy beam, a first linac, and a second linac having an input end and an output end;

b. a plurality of up arcs between the first linac and second linac including a first up arc, a second up arc, and a third up arc;

c. a plurality of downgoing arcs between the first linac and second linac including a first downgoing arc, a second downgoing arc, and a third downgoing arc;

d. a full energy arc between the output end and the input end of the second linac; and e. a beam dump at the end of the first linac.

16. The separated-orbit bisected energy-recovered linear accelerator of claim 15 wherein each of the up arcs have a path length that is substantially a multiple of the RF wavelength.

17. The separated-orbit bisected energy-recovered linear accelerator of claim 15 wherein each of the downgoing arcs have a path length that is substantially a multiple of the RF wavelength.

18. The separated-orbit bisected energy-recovered linear accelerator of claim 15 wherein the full energy arc includes a path length that is substantially an odd half-integer multiple of the RF wavelength.

* * * * *